US010035568B2

(12) United States Patent
Taylor

(10) Patent No.: US 10,035,568 B2
(45) Date of Patent: Jul. 31, 2018

(54) SUBSEA CONNECTOR

(71) Applicant: Flintstone Technology Limited, Dundee (GB)

(72) Inventor: Richard Taylor, Kendal (GB)

(73) Assignee: Flintstone Technology Limited, Dundee (GB)

( * ) Notice: Subject to any disclaimer, the term of this patent is extended or adjusted under 35 U.S.C. 154(b) by 142 days.

(21) Appl. No.: 14/406,951

(22) PCT Filed: Jun. 11, 2013

(86) PCT No.: PCT/GB2013/051535

§ 371 (c)(1),
(2) Date: Dec. 10, 2014

(87) PCT Pub. No.: WO2013/186553

PCT Pub. Date: Dec. 19, 2013

(65) Prior Publication Data

US 2015/0251731 A1 Sep. 10, 2015

(30) Foreign Application Priority Data

Jun. 11, 2012 (GB) ..... 1210263.8
Nov. 6, 2012 (GB) ..... 1219982.4

(51) Int. Cl.
*B63B 21/00* (2006.01)
*B63B 21/50* (2006.01)
*B63B 21/20* (2006.01)

(52) U.S. Cl.
CPC ..... *B63B 21/50* (2013.01); *B63B 21/20* (2013.01); *B63B 2021/005* (2013.01); *B63B 2021/505* (2013.01)

(58) Field of Classification Search
CPC ..... B63B 22/04; B63B 21/20; B63B 21/50; B63B 21/502; B63B 2021/505; Y10T 403/593
(Continued)

(56) References Cited

U.S. PATENT DOCUMENTS 1,425,525 A 8/1922 Hollick
2,508,832 A * 5/1950 McAninch ..... 403/359
(Continued)

FOREIGN PATENT DOCUMENTS

CN 2326490 Y 6/1999
DE 1 806 131 10/1968
(Continued)

OTHER PUBLICATIONS

Notification of Transmittal of the International Search Report and the Written Opinion of the International Searching Authority, or the Declaration, PCT/GB2013/051535, dated Nov. 19, 2013, 12 pages.
(Continued)

*Primary Examiner* — Daniel V Venne
(74) *Attorney, Agent, or Firm* — Myers Bigel, P.A.

(57) ABSTRACT

There is disclosed a subsea connector (100), e.g. a mooring connector, and a method of mooring a subsea structure to a line, e.g. a mooring chain, with the subsea connector. The subsea connector comprises a first portion (105) and a second portion (110), means for connecting (120) the first portion and the second portion, and means for rotationally aligning the first portion and the second portion. The first and second portions are connectable to a respective line, such as a respective mooring chain. The means for rotationally aligning comprise a first alignment member at least partly spanning across a bore, such as an internal bore, of the first or second portion. The means for rotationally aligning comprise a second alignment member provided by the other
(Continued)

of the first or second portion. The first and second alignment members co-act when the first and second portions are brought together or mated.

33 Claims, 9 Drawing Sheets

(58) Field of Classification Search
USPC ..... 114/230.2, 230.28, 294, 230.26; 405/169, 170, 172, 184.4, 195, 195.1, 405/223.1, 224; 403/322, 322.3; 166/338, 340, 339, 341
See application file for complete search history.

(56) References Cited

U.S. PATENT DOCUMENTS

| | | | | |
|---|---|---|---|---|
| 2,572,419 | A | 10/1951 | Wyss | |
| 2,821,277 | A * | 1/1958 | Hughes | F16D 11/10 192/114 R |
| 2,926,034 | A | 2/1960 | Weaver | |
| 3,050,140 | A | 8/1962 | Hayes | |
| 3,072,430 | A | 1/1963 | Fahrenwald | |
| 3,182,280 | A | 5/1965 | Daut et al. | |
| 3,219,373 | A | 11/1965 | Sutliff | |
| 3,290,918 | A * | 12/1966 | Weasler | F16D 1/10 29/893.2 |
| 3,517,953 | A * | 6/1970 | Barbee | B25B 23/0035 279/77 |
| 3,604,731 | A | 9/1971 | Petersen | |
| 3,845,973 | A | 11/1974 | Houot | |
| 4,060,298 | A | 11/1977 | Gearin | |
| 4,067,385 | A | 1/1978 | Schwager et al. | |
| 4,095,649 | A | 6/1978 | Chateau et al. | |
| 4,161,367 | A | 7/1979 | Cuiper et al. | |
| 4,209,891 | A | 7/1980 | Lamb et al. | |
| 4,417,830 | A | 11/1983 | Shotbolt | |
| 4,568,221 | A | 2/1986 | Lerique | |
| 4,676,696 | A | 6/1987 | Laursen | |
| 4,736,799 | A | 4/1988 | Ahlstone | |
| 4,938,731 | A | 7/1990 | Nguyen et al. | |
| 4,943,188 | A * | 7/1990 | Peppel | 405/224 |
| 5,320,175 | A | 6/1994 | Ritter et al. | |
| 5,561,570 | A | 10/1996 | Gill et al. | |
| 6,305,867 | B1 | 10/2001 | Schweigert et al. | |
| 6,615,554 | B2 | 9/2003 | Rupiper | |
| 7,066,103 | B2 | 6/2006 | Palmquist | |
| 7,448,823 | B2 | 11/2008 | Silva | |
| 2006/0284048 | A1 | 12/2006 | Cobb, Jr. | |
| 2011/0188922 | A1 | 8/2011 | Thacker et al. | |
| 2011/0240403 | A1 | 10/2011 | Meillet | |
| 2012/0031320 | A1 | 2/2012 | Bauduin | |

FOREIGN PATENT DOCUMENTS

| | | | |
|---|---|---|---|
| EP | 0 302 546 | | 2/1989 |
| EP | 2 207 242 | A2 | 7/2010 |
| FR | 2 563 606 | A1 | 10/1985 |
| GB | 1 098 852 | | 1/1968 |
| GB | 1 260 707 | | 1/1972 |
| GB | 2 026 061 | A | 1/1980 |
| GB | 2 178 101 | A | 2/1987 |
| GB | 2 216 345 | A | 10/1989 |
| GB | 2 436 920 | A | 10/2007 |
| GB | 2 466 992 | A | 7/2010 |
| GB | 2 496 700 | A | 5/2013 |
| WO | WO 89/11415 | | 11/1989 |
| WO | WO 2006/043897 | A1 | 4/2006 |
| WO | WO 2009/136223 | A1 | 11/2009 |
| WO | WO 2013/091920 | A1 | 6/2013 |
| WO | WO 2013/114105 | A1 | 8/2013 |

OTHER PUBLICATIONS

Search Report, GB 1210263.8, dated May 14, 2013, 5 pages.
"PLT: Pile Pinned Lift Tool | Offshore Pile Handling Tool | LDD" retrieved from http://www.lddrill.com/broducts-services-45/lm-handling187/bIt-bile-pinned-lift-tool-189 on Dec. 11, 2014 (Publication date: Nov. 13, 2014, 3 pages (Admitted Prior Art)).

* cited by examiner

SUBSEA CONNECTOR

RELATED APPLICATIONS

This application is a 35 U.S.C. § 371 national stage application of PCT Application No. PCT/GB2013/051535, filed on Jun. 11, 2013, which claims priority from British Application Nos. 1210263.8, filed on Jun. 11, 2012 and 1219982.4, filed on Nov. 6, 2012, the contents of which are incorporated herein by reference in their entireties. The above-referenced PCT International Application was published in the English language as International Publication No. WO 2013/186553 A1 on Dec. 19, 2013.

FIELD OF INVENTION

The present invention relates to a connector, and particularly, though not exclusively, to a subsea or underwater connector, e.g. for connecting a line or lines such as in the installation, mooring, anchoring or the like of apparatus or equipment.

BACKGROUND TO INVENTION

In order to connect a line or lines, e.g. wire, chain or synthetic (such as polyester), lines for the installation, mooring or anchoring of equipment used subsea or underwater, e.g. in oil, gas, offshore wind and tidal energy industries, there needs to be a means of connecting and disconnecting the line or lines. Uses include installing a small subsea structure which can be lifted from the rear or back of a boat or from a rig and lowered to the sea-bed, through to permanent mooring of a floating production structure. On top-side this is straight-forward; however, when subsea beyond diver depth there needs to be a means or device such that a remotely operated vehicle (ROV) may both connect and disconnect the line. There are several such devices known in the art. However, these suffer from a number of short-comings or disadvantages. Even when not operating beyond diver depth, such a device may be desired, since many operators do not want to use divers even where practical. There is therefore a need for a new, simple, robust and easy to use connector.

A known device is the Delmar Subsea Connector as described in U.S. Pat. No. 6,158,093 (DELMAR SYSTEMS, INC.), the content of which is incorporated herein by reference. The Delmar connector requires buoyancy/heave compensation for installation, and is manufactured as a casting which rules such out of some projects. Further, the Delmar connector has no inherent alignment and is similar to a loose shackle.

Another known type of connector is the so-called ball and taper connector. Such are commercially available from Balltec Limited (www.balltec.com) as MoorLok™ and from First Subsea Limited (www.firstsubsea.com) as Ballgrab™. The Balltec connector is described in WO 2006/109065 A1, the content of which is incorporated herein by reference.

Ball and taper connectors utilise the ball and taper principle as schematically illustrated in FIG. 1. The ball and taper connector 5 comprises a male portion or mandrel 10 and a female portion or receptacle 15. The male portion 10 carries a ball cage 20 and a plurality of balls 25. When the male portion 10 and ball cage 20 enter the female portion 15 and (longitudinal) load is applied, the balls 25 contact an inner face 30 of the female portion 15. A resultant (radial) force is produced and a connection formed between the male portion 10 and female portion 15. If the load is removed, the ball cage 20 is drawn back, the balls 25 lose contact with the female portion 15, and the connection separates.

SUMMARY OF INVENTION

According to a first aspect of the present invention there is provided a connector, such as a subsea, mooring or underwater connector, comprising a first portion and a second portion, means for connecting the first portion and the second portion, and means for rotationally aligning the first portion and the second portion.

The first and second portions may be connectable to a respective line, such as a respective mooring chain.

The means for rotationally aligning the first and second portion may comprise means carried by or provided on the first and/or second portion. The means for rotationally aligning may comprise a first alignment member at least partly spanning across a bore, such as an internal bore, of the first or second portion. The first alignment member may be partially transverse to the bore with respect to a longitudinal axis of the first or second portion.

The means for rotationally aligning may comprise a second alignment member, such as a rotational alignment member, provided by the other of the first or second portion. The first and second alignment members may co-act when the first and second portions are brought together or mated.

The first portion may comprise a male part.

The second portion may comprise a female part.

The means for connecting may comprise means for releasably connecting.

The means for rotationally aligning the first portion and the second portion may comprise first and second means carried by or provided on the first and second portions, respectively. The first and second means may comprise the first and second alignment members, respectively.

The first and second means may co-act, in use, when the first and second portions are brought together or mated.

The first means may comprise at least one first surface. The second means may comprise at least one second surface. An at least one first surface(s) and a second surface may abut one another and/or rotate with respect to one another around a longitudinal axis and/or ride-over one another when the first and second portions are longitudinally brought together or mated.

The first means may comprise at least a first prong or tooth, and advantageously first and second prongs or teeth. The first and second prongs or teeth may be diametrically or width-wise opposite one another, i.e. disposed on opposite sides of or along a common diameter or width. Each prong or tooth may be disposed on a respective radial portion of an end of the first means. A slot or recess portion may be provided between the first and second prongs or teeth.

The male part may comprise a cylindrical portion, e.g. a cylindrical mid-portion. The female part may comprise a bore, e.g. a cylindrical bore, e.g. within which the cylindrical portion is received in a substantially tight or snug fit.

The second means may comprise an elongate or cross member or alignment bar. The elongate member may at least partly span, e.g. diametrically span, the female part, e.g. the bore. The elongate member may comprise an outer (upper) facing curved surface and may be substantially cylindrical or elliptical in cross-section.

In use, insertion of the male part into the female part may cause the first means and second means to rotationally co-act or ride over one another, thereby relatively (longitudinally) rotating the male part and the female part into a pre-selected or pre-determined rotational disposition.

The first prong or tooth, and where provided second prong or tooth, may provide the at least one first surface, which may comprise an outer surface thereof.

The/each prong or teeth/tooth may comprise one or more of:

a first chamfered, sloping or angled side surface, a second chamfered, sloping or angled side surface (preferably disposed symmetrically with the first side surface), a flat/planar inner surface which may comprise a surface of the slot, and a curved outer surface. The flat planar inner surface may taper or flare outwards towards an end of the prong or tooth.

A first side surface of a first tooth may be continuous with a first side surface of a second tooth. A second side surface of a first tooth may be continuous with a second side surface of the second tooth.

The elongate member may provide the at least second surface, which may comprise an outer surface thereof, e.g. said outer (upper) facing curved surface.

Once in the pre-selected rotational disposition the first and second prongs may be disposed on respective first and second sides of the elongate member. A portion of the male part between the prongs or teeth (e.g. a root or web portion), e.g. base of the slot portion may be adjacent or in contact, e.g. abutting contact, with the elongate member.

The means for connecting the first portion and the second portion may comprise a first aperture in the male part, e.g. diametrically or width-wise spanning the cylindrical portion of the male part.

The means for connecting the first portion and the second portion may comprise at least one second aperture, e.g. a pair of diametrically opposed apertures, in the female part.

The means for connecting the first portion and the second portion may comprise a pin, e.g. a load (bearing) pin, removably receivable within the first and second apertures when such are aligned.

Beneficially, the first and second apertures are aligned in said pre-selected rotational disposition.

In use, an ROV (remotely operated vehicle) may be used to mate and/or release the first and second parts, e.g. subsea/underwater, and/or to insert and/or remove the pin.

The pin may have a tapered end, which may facilitate insertion thereof into the apertures.

Beneficially, the first portion, second portion and/or pin may be made from a metal or metallic material. Beneficially the first portion, second portion and/or pin are made by forging. A distal end of each of the first portion and the second portion may comprise means for connecting to the line. Alternatively, the line may be wire, synthetic (e.g. polyester). The line connection means may comprise a clevis fastener, e.g. comprising a clevis, clevis pin and tang.

A perimeter of the first aperture may comprise a first perimeter portion and a second perimeter portion.

The second perimeter portion may be provided closer to an end of the first portion than the first perimeter portion.

The first perimeter portion may comprise a portion of the circumference of a first circle (of the radius $R_1$).

The second perimeter portion may comprise a portion of the circumference of a second circle (of radius $R_2$).

Beneficially $R_1$ may be greater than $R_2$.

A centre of the second circle may be closer to an end of the first portion than a centre of the first circle may be to the end of the first portion.

A perimeter of the second aperture(s) may comprise the circumference of a third circle (of radius $R_3$).

According to a second aspect of the present invention there is provided a connector, such as a subsea connector, comprising a male part and a female part and a pin for releasably connecting the male part and the female part together.

The male part may comprise a first portion.

The female part may comprise a second portion.

The male part may comprise a first aperture, e.g. diametrically or width-wise, spanning the male part, e.g. a cylindrical portion of the male part.

The female part may comprise at least one second aperture, e.g. a pair of diametrically opposed apertures. The pin may be removably insertable with the first and second apertures, e.g. when the first and second apertures are rotationally aligned.

A perimeter of the first aperture may comprise a first perimeter portion and a second perimeter portion.

The second perimeter portion may be provided closer to an end of the first portion than the first perimeter portion.

The first perimeter portion may comprise a portion of the circumference of a first circle (of the radius $R_1$).

The second perimeter portion may comprise a portion of the circumference of a second circle (of radius $R_2$).

Beneficially $R_1$ may be greater than $R_2$.

A centre of the second circle may be closer to an end of the first portion than a centre of the first circle may be to the end of the first portion.

A perimeter of the second aperture(s) may comprise the circumference of a third circle (of radius $R_3$).

Optional features of the second aspect may comprise features of the first aspect, whether taken alone or in combination with the first aspect, and such features are not repeated herein merely for reasons of brevity.

According to a third aspect of the present invention there is provided a first portion according to the first aspect, or a male part according to the second aspect of the present invention.

According to a fourth aspect of the present invention there is provided a second portion according to the first aspect, or a female part according to the second aspect of the present invention.

According to a fifth aspect of the present invention there is provided a subsea, underwater or offshore equipment, apparatus or structure moored, anchored or fixed by one or more lines, at least one of the lines comprising at least one connector according to at least one of the first or second aspects of the present invention.

According to a sixth aspect of the present invention there is provided a method of mooring, anchoring or fixing a subsea, underwater or offshore equipment, apparatus or structure by one or more lines comprising the step of connecting at least one of said lines with a connector according to the first or second aspects of the present invention.

BRIEF DESCRIPTION OF DRAWINGS

An embodiment of the present invention will now be described by way of example only, and with reference to the accompanying drawings, which are.

DETAILED DESCRIPTION OF DRAWINGS

Figure 1:
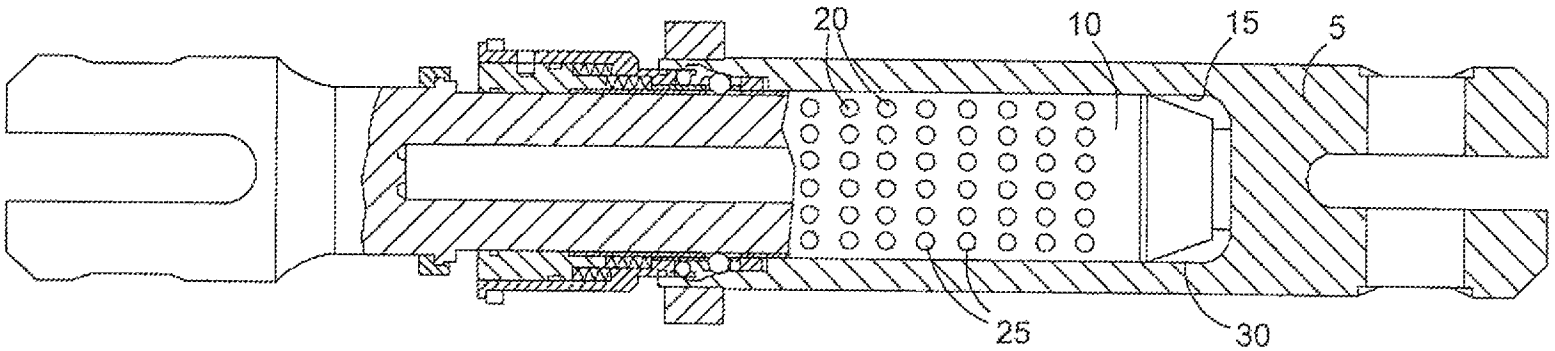
FIG. 1 a schematic cross-sectional view of part of a ball and taper connector according to the prior art.

Referring to FIGS. 2 to 5, there is shown a connector, particularly a subsea or underwater connector, generally designated 100 according to an embodiment of the present invention. The connector 100 comprises a first portion 105 and a second portion 110, means 115 for connecting the first portion 105 and the second portion 110, and means 120 for rotationally aligning the first portion 105 and the second portion 110.

The first portion 105 comprises a male part 125. The second portion 110 comprises a female part 130. The means for connecting 115 comprises means for releasably connecting. The means 120 for rotationally aligning the first portion 105 and the second portion 110 comprises first and second means 135,140 carried by or provided on the first and second portion 105,110, respectively. The first and second means 135,140 co-act, in use, when the first and second portions 105,110 are brought together or mated.

The first means 135 comprises at least one first surface. The second means 140 comprises at least one second surface. In use, the first surface(s) and the second surface(s) abut and rotate with respect to one another and/or ride over one another around a longitudinal axis when the first and second portions 105,110 are longitudinally brought together.

In this embodiment the first means 135 comprises first and second prongs or teeth 145,150. The first and second prongs or teeth 145,150 are diametrically or width-wise opposed to one another. Also in this embodiment the first and second prongs or teeth 145,150 are shaped as described hereinbelow. A slot portion 151 is provided between the first and second prongs or teeth 145,150.

The male part 125 comprises a cylindrical mid portion 155. The female part 130 comprises a cylindrical bore 160.

The second means 140 comprises an elongate member 140 (or alignment bar). The elongate member 140 spans at least partly, e.g. diametrically spans, the cylindrical bore 160 of the female part 130. The elongate member 1401 is partially transverse to the bore 160 of the female part 130. The elongate member 140 comprises an outer facing curved surface, and in this embodiment is substantially cylindrical in cross-section.

In use, insertion of the male part 125 into the female part 130 causes the first means 135 and second means 140 to rotationally co-act and/or ride over one another, thereby relatively rotating the male part 125 and the female part 130 into a pre-selected rotational disposition. The first and second prongs or teeth 145,150 provide the at least one first surface, i.e. in this embodiment a pair of first surfaces, which comprise outer surfaces thereof. The/each prong or tooth comprises: a first chamfered or sloping side surface 154*a*, a second chamfered or sloped side surface 154*b*, a flat inner surface 154*c*, and a curved outer surface 154*d*.

The elongate member 140 provides the at least one second surface which comprises an outer surface thereof.

Once in the pre-selected rotational disposition, the first and second prongs or teeth 145,150 are disposed respective first and second sides of the elongate member 140. A portion 165 of the male part 125 between the prongs or teeth 145,150 (e.g. a web portion), e.g. base of the slot portion, is adjacent or in contact, e.g. abutting contact, with the elongate member 140.

The means 115 for connecting the first portion 105 and the second portion 110 comprise a first aperture 120 in the male part 125, e.g. diametrically or width-wise spanning the cylindrical portion 155 of the male part 125. The means 115 for connecting the first portion 105 and the second portion 110 comprise at least one second aperture 175, e.g. a pair of diametrically or width-wise opposed apertures, in the female part 130. The means 115 for connecting the first portion 105 and the second portion 110 comprise a pin 180, e.g. a load (bearing) pin, removably receivable within the first and second apertures 170,175 when such are aligned in said pre-selected disposition.

Beneficially, the first and second apertures 170,175 are aligned in said pre-selected rotational disposition. The pin 180 can be releasably retained in the apertures 170,175, e.g. by interacting screw threads and/or a tang (not shown).

In use, an ROV (remotely operated vehicle) can be used to mate (and/or release) the first and second portions 105, 110, e.g. subsea/underwater and/or to insert (and/or remove) the pin 180. The pin 180 has a tapered end, which can facilitate insertion thereof into the aligned apertures 170, 175.

Beneficially, the first portion 105, second portion 110 and/or pin 180 are made from a metal or metallic material. Beneficially the first portion 105, second portion 110 and/or pin 180 are made by forging.

Figure 9:
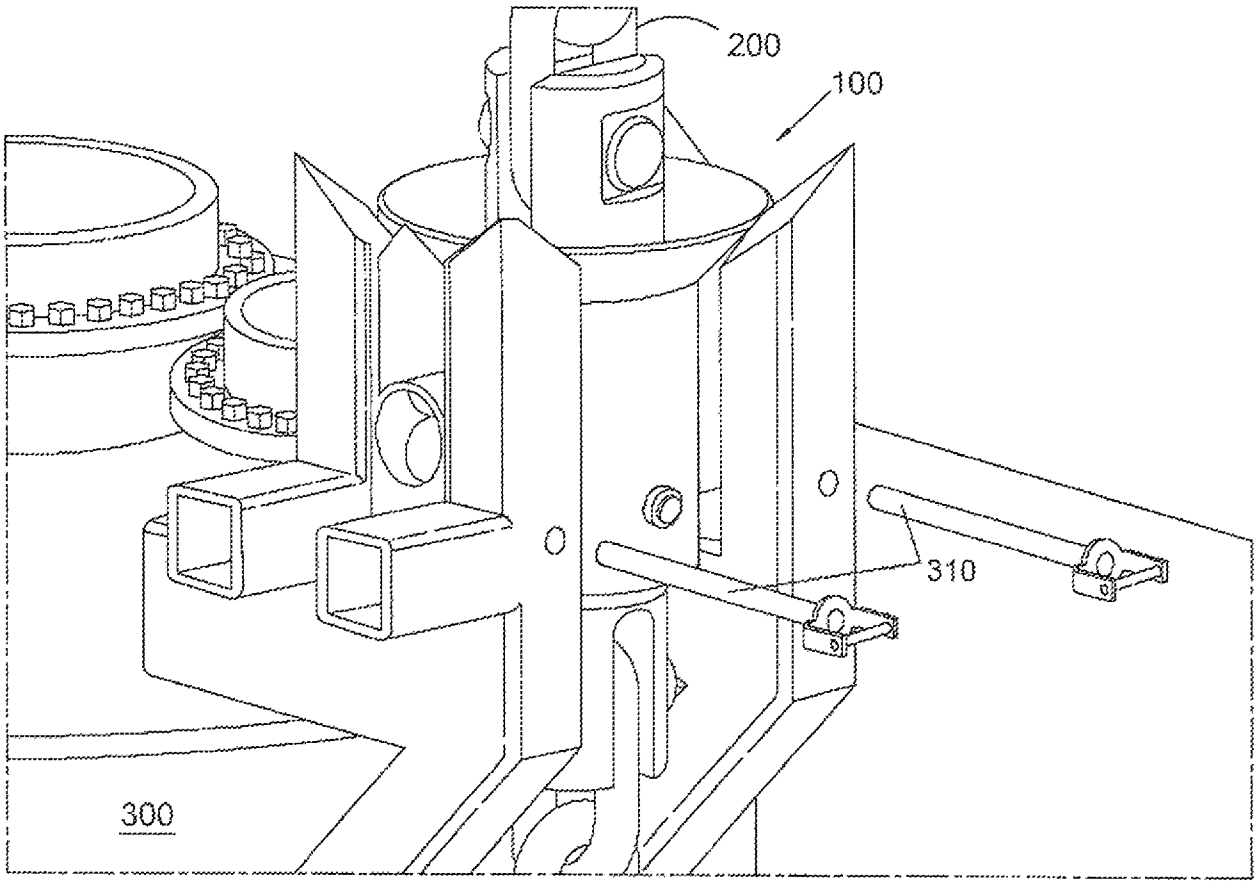
FIG. 9 a schematic view similar to FIG. 8 with retention means removed.
Figure 10:
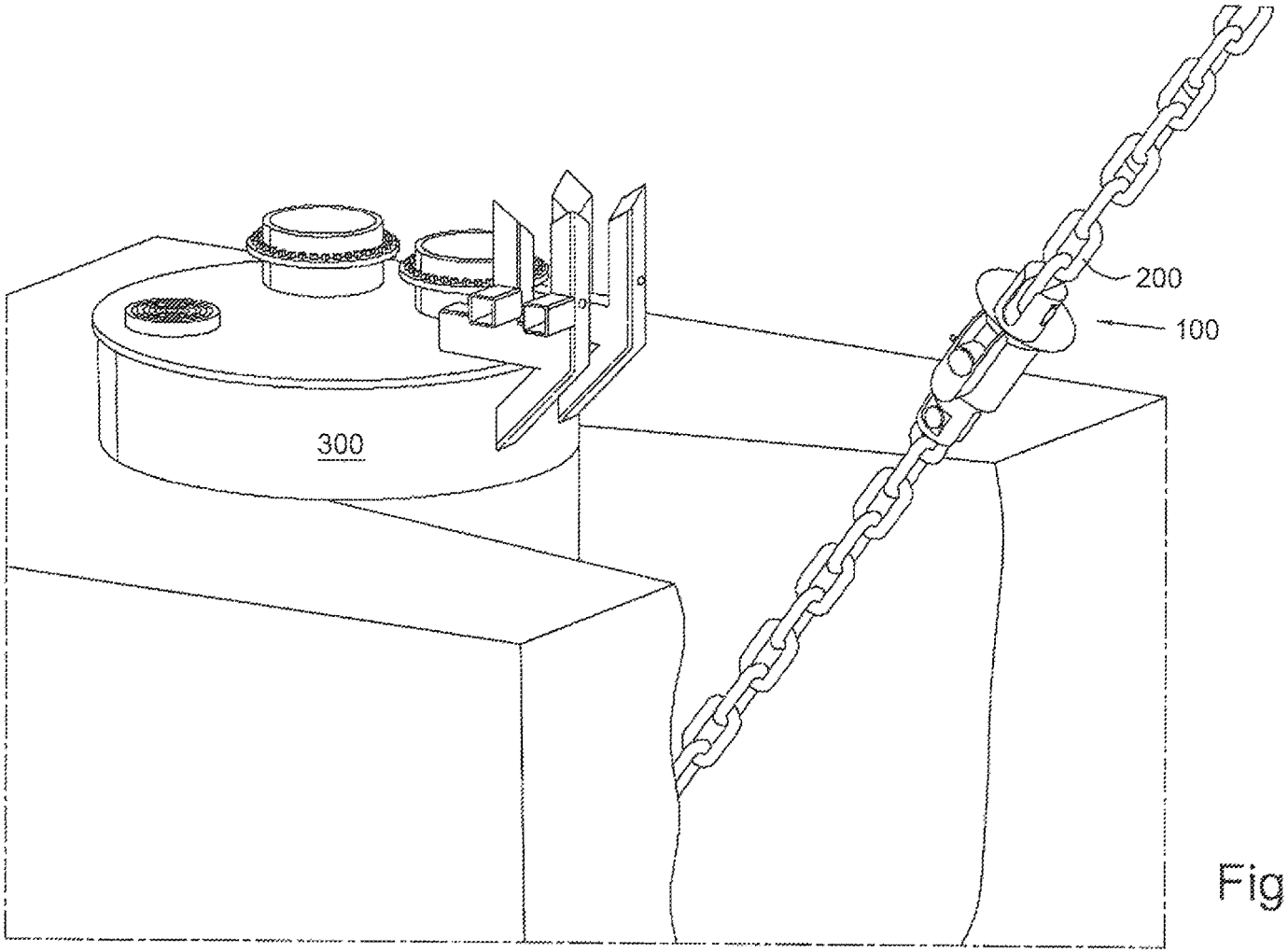
FIG. 10 a schematic view of the connector deployed.

Distal ends 185,190 of each of the first portion 105 and the second portion 110 comprises means 195,196 for connecting to line. Referring to FIG. 9, the line 200 can be wire, chain, synthetic (e.g. polyester). The line connection means 195, 196 comprises a clevis fastener, e.g. comprising a clevis, clevis pin and tang.

The connector 100 comprises male part 125 and female part 130 and a pin 180 for releasably connecting the male part 125 and the female part 130 together. The male part 125 comprises a first portion 105. The female part 130 comprises a second portion 110.

Referring now to FIGS. 6 to 10, there is shown a subsea, underwater or offshore equipment, apparatus or structure 300 moored, anchored or fixed by one or more lines 200, at least one of the lines 200 comprising at least one connector 100.

In use, a method of mooring, anchoring or fixing an offshore equipment, apparatus or structure 300 with one or more lines 200 comprises the step of connecting at least one of the said lines 200 with or by a connector 100.

Figure 2:
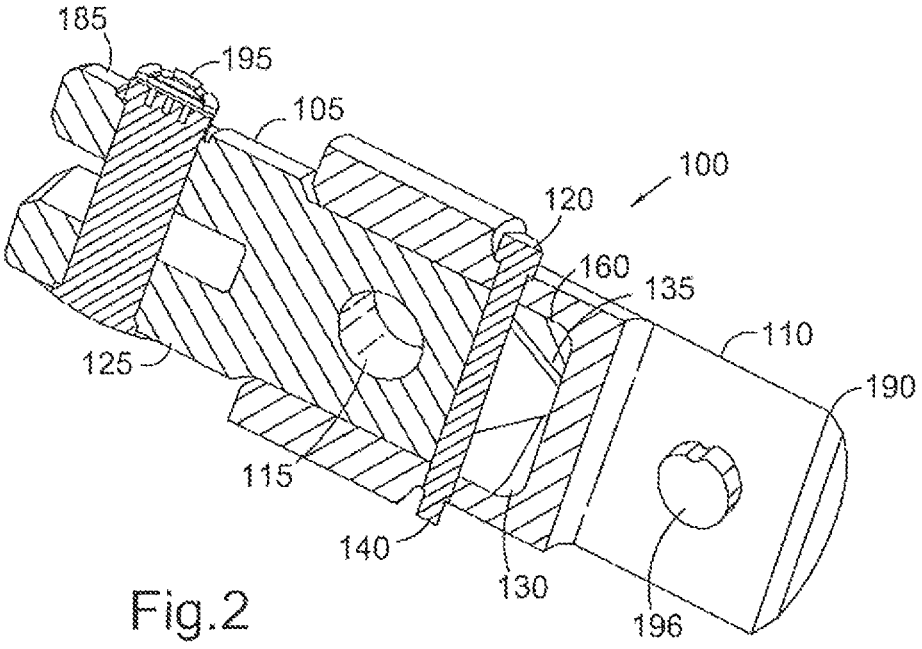
FIG. 2 a perspective cross-sectional view of a connector according to an embodiment of the present invention prior to connection.
Figure 3:
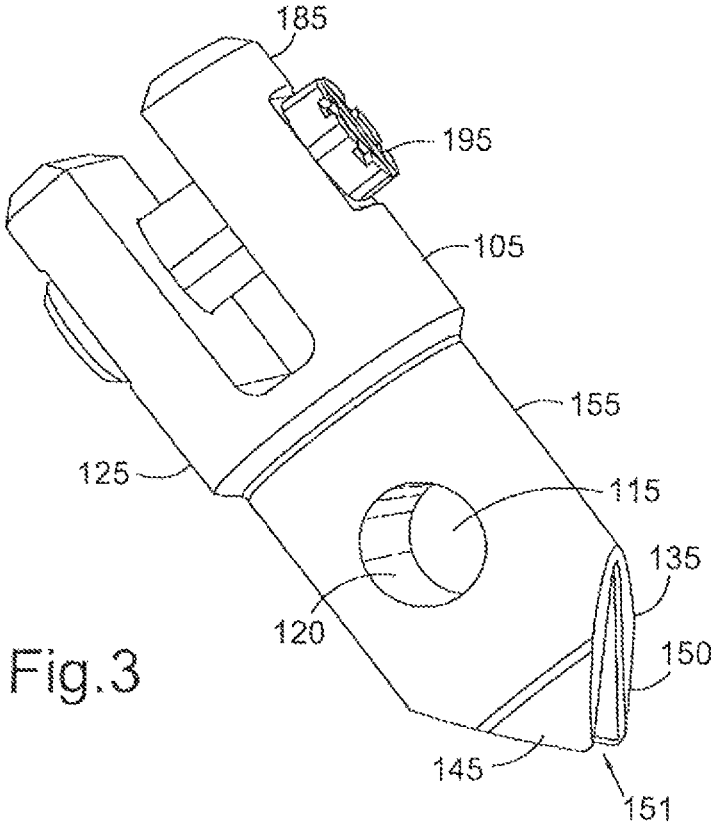
FIG. 3 a perspective view of a first portion of the connector of FIG. 2.
Figure 4:
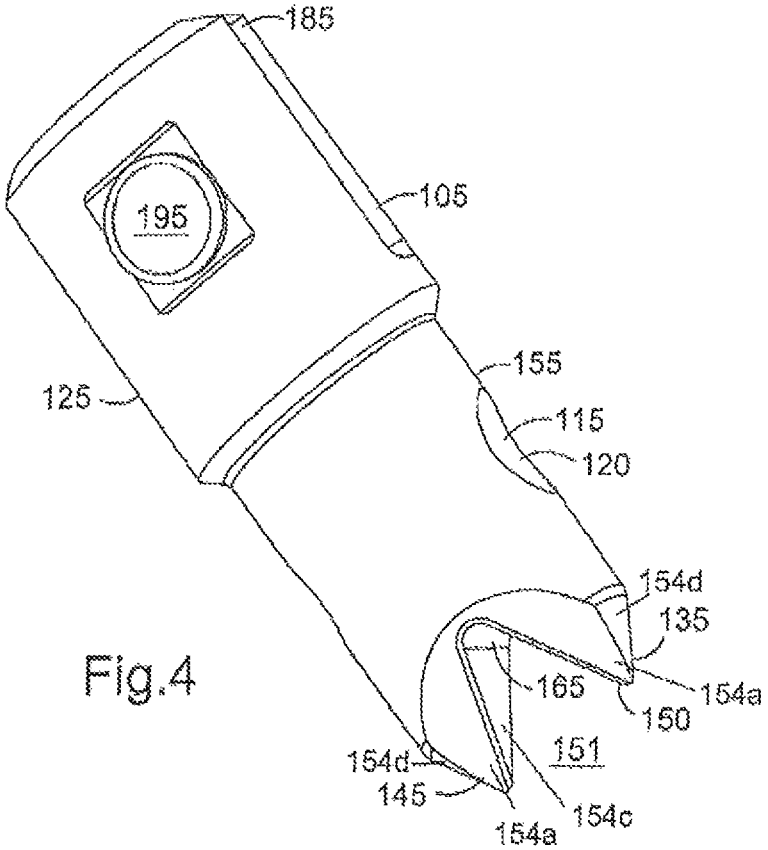
FIG. 4 a further perspective view of the first portion of the connector of FIG. 2 rotated through 90° with respect to FIG. 3.
Figure 5:
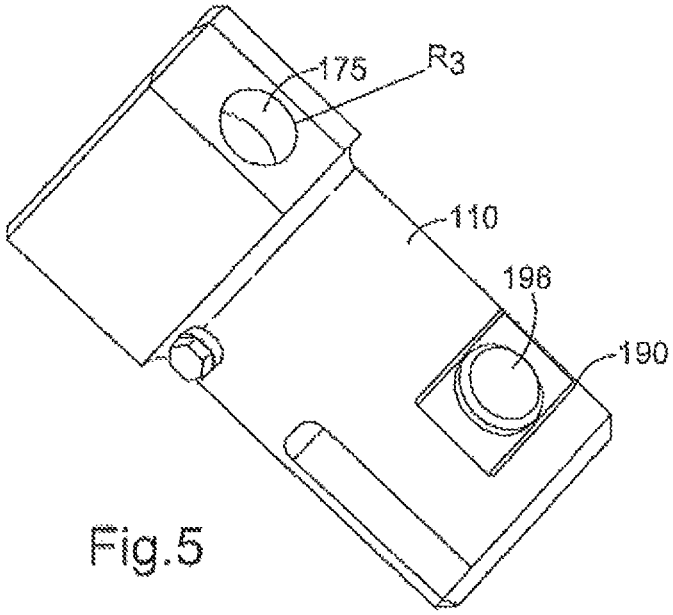
FIG. 5 a perspective view of a second portion of the connector of FIG. 2.
Figure 6:
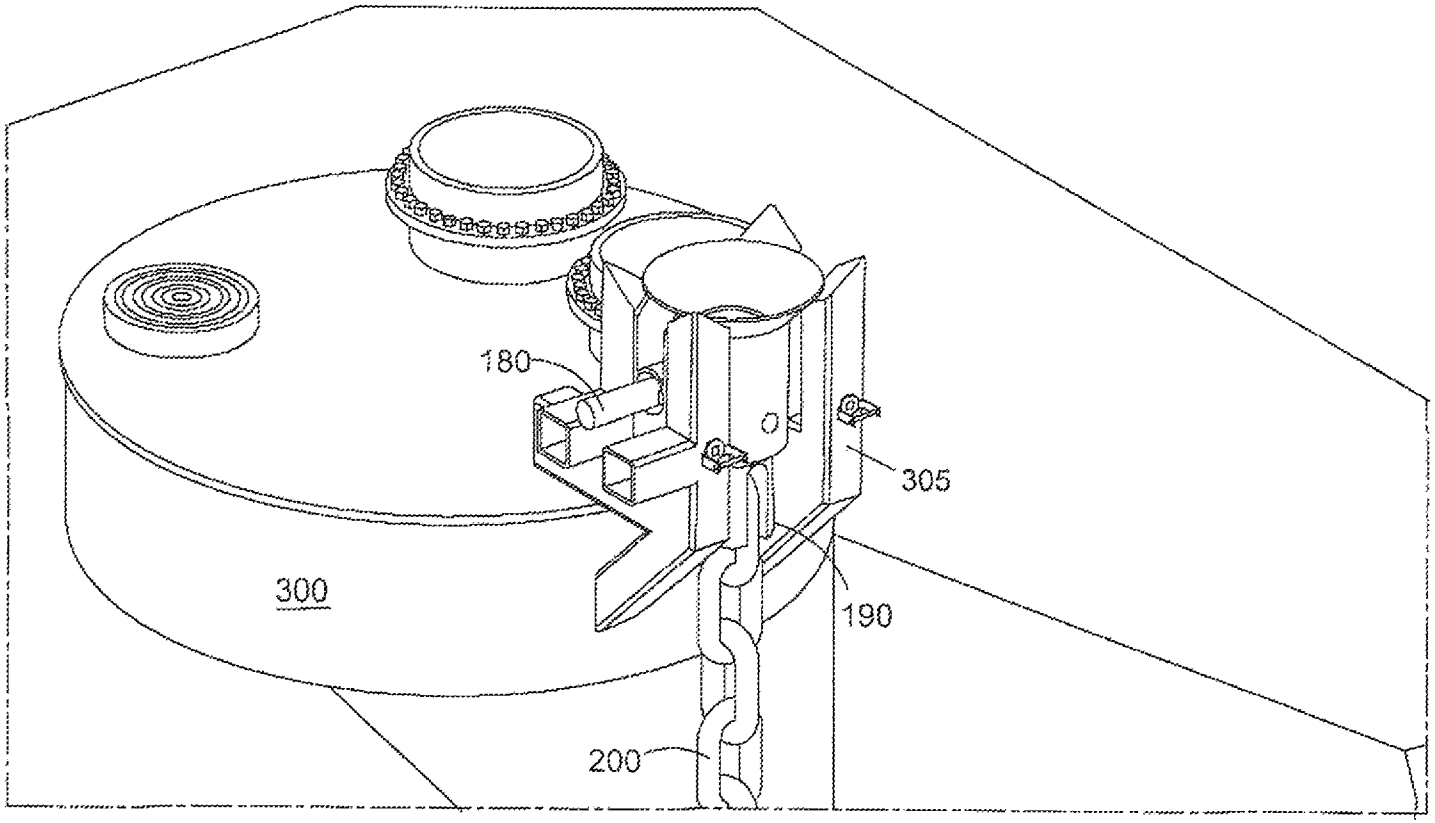
FIG. 6 a schematic view of a second portion of the connector of FIG. 2 mounted on a suction pile.

Referring initially to FIG. 6, the second portion 110 of the connector 10 of FIG. 2 is mounted on a suction pile 300. The portion of a line extends from the second portion 110 of the connector to a base portion of the suction pile 300. The second portion 110 is retained by retaining pins in a retaining cradle 305. The second portion 110 is further provided with an outer cylindrical housing 197 having an upper end thereof an open inverted frusto-conical portion or guide cone 198 which communicates with the female part.

The guide cone 198 assists in lowering the male part 125 into the female part 130. The receiving cradle 305 comprises spaced support means in order to assist receiving or parking the female part 130 in the receiving cradle on the side of the suction pile. The receiving cradle 305 holds the female part 130 securely on the suction pile 300 as the pile 300 is lifted to the sea-bed and holds such in a vertical orientation for insertion of the male part 125.

Figure 7:
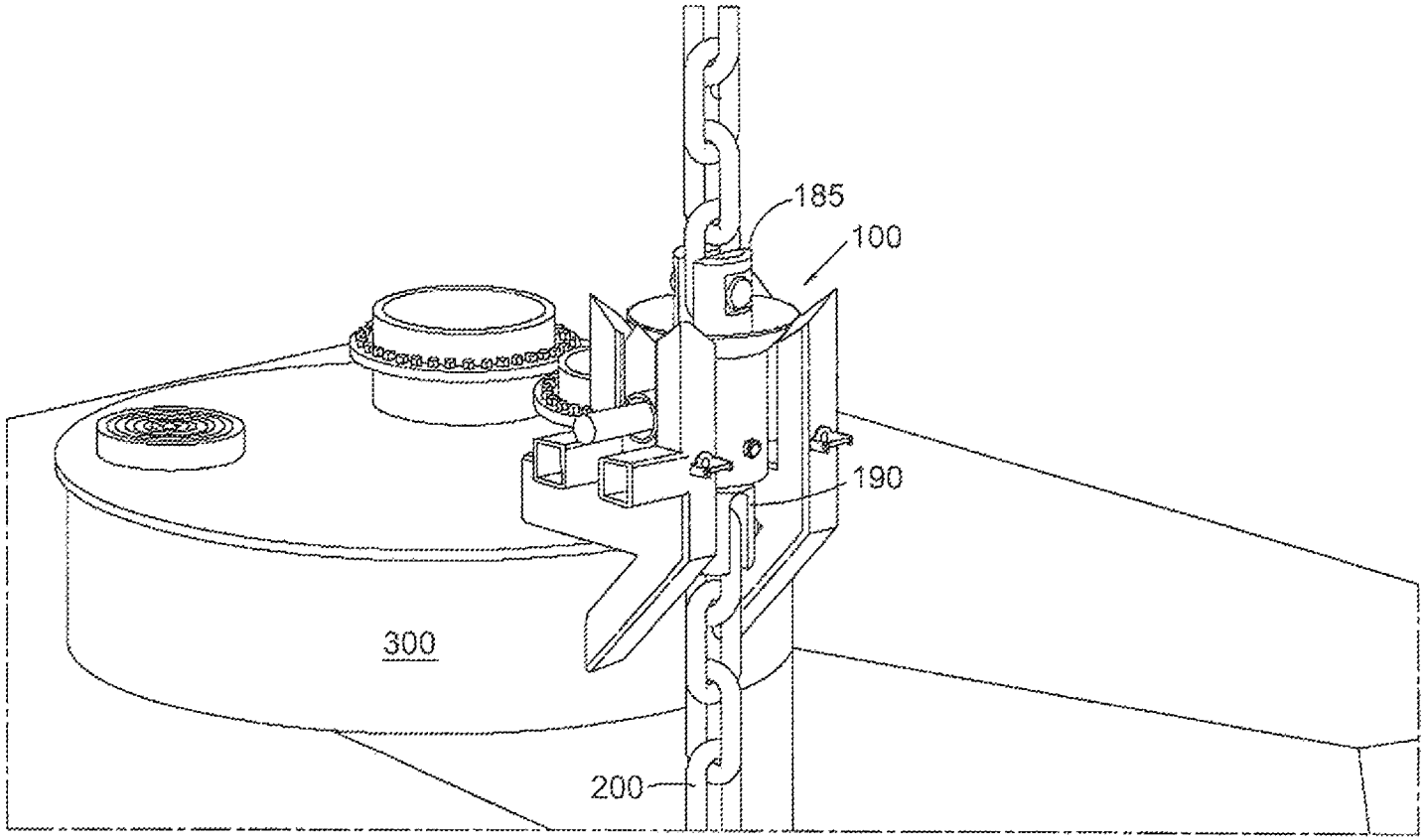
FIG. 7 a schematic view of the connector of FIG. 2 mounted on the suction pile of FIG. 6 with the first portion received by and within the second portion.

Referring to FIG. 7, the male part 125 is presented to the female part 130, and the male part 125 being connected to a second portion of the line.

Figure 8:
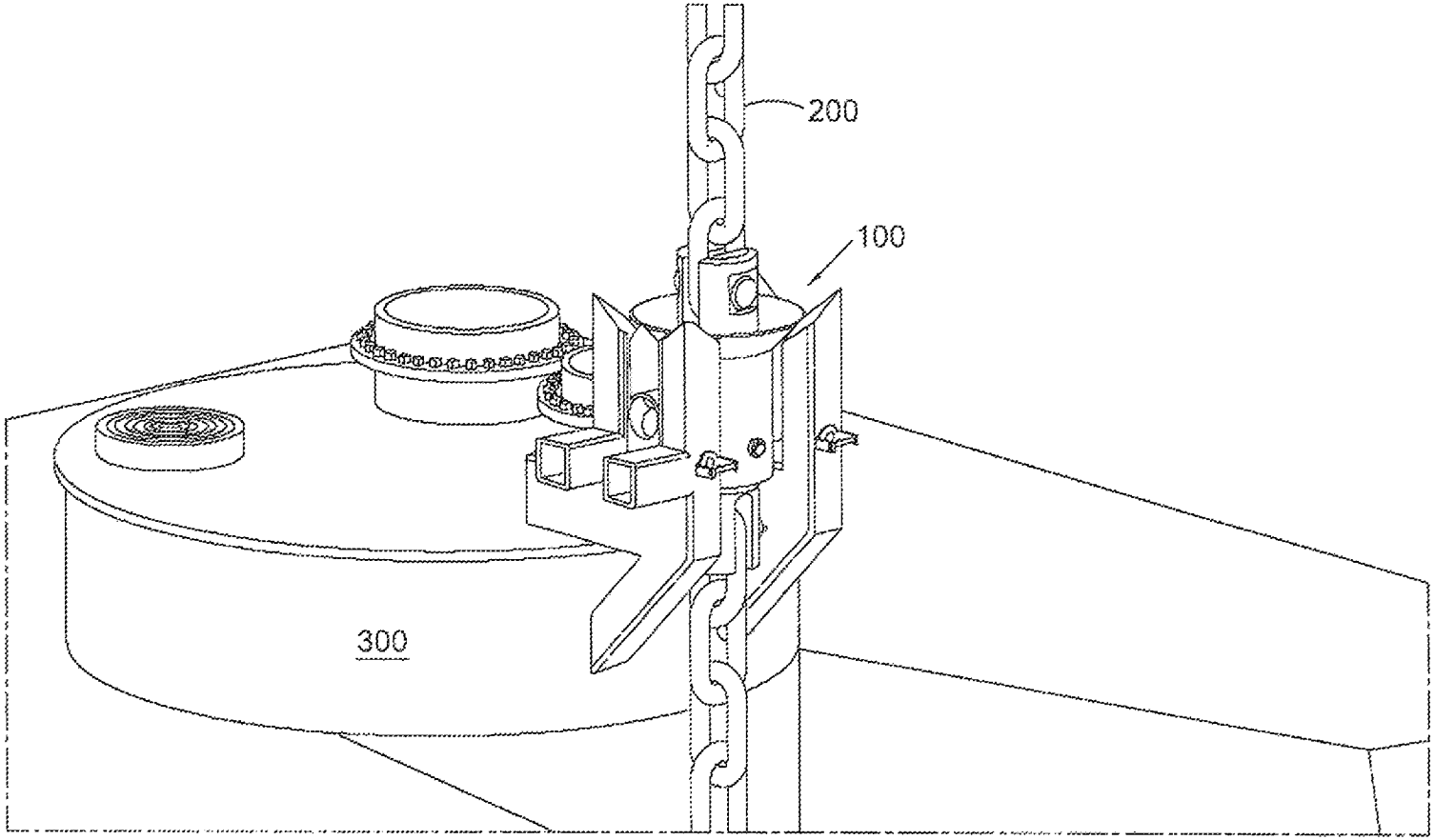
FIG. 8 a schematic view of the connector of FIG. 2 mounted on a suction pile with the first portion received by and within the second portion and connection means in place.

Referring to FIGS. 7 and 8, a locking pin 180 is inserted into the aligned apertures of the first and second parts 125,130 so as to connect them together.

Referring to FIG. 9, retaining means or retaining pins 310 are removed so as to allow release of the second part 130 from the retaining cradle.

Figure 11:
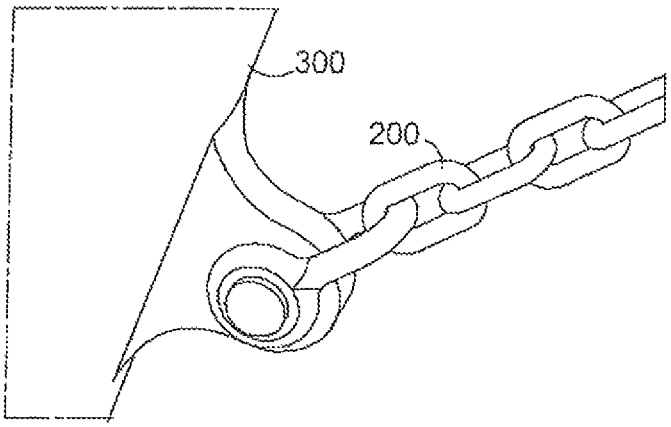
FIG. 11 a schematic view of the suction pile and a line connected thereto.

Referring to FIG. 11, the line 200 comprising the first portion of line and second portion of line connected by the connector 10 can then be deployed, so as to anchor the offshore equipment apparatus or structure via the suction pile 300.

Referring to FIG. 11, it can be seen that the first portion of the line is connected to the suction pile 300 via a welded pad eye.

Figure 12:
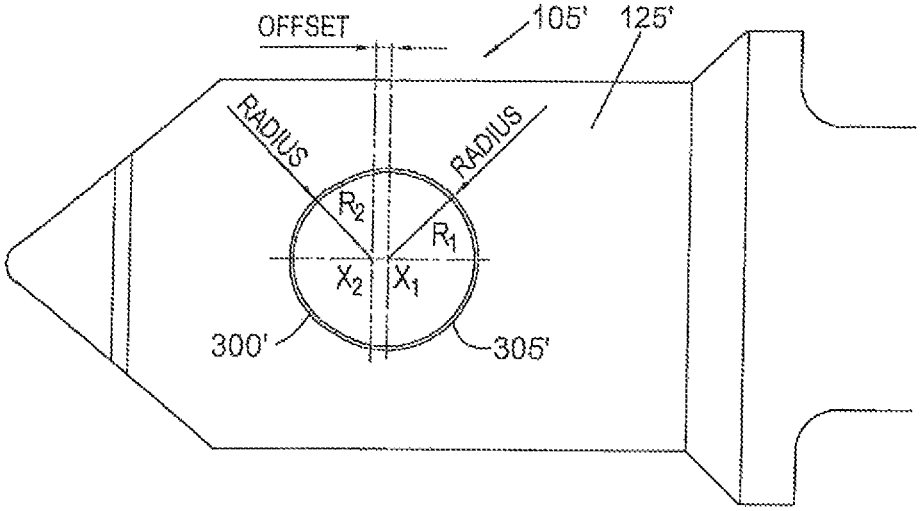
FIG. 12 a side view of a modified first portion according to an alternative embodiment of the present invention.

Referring now to FIG. 12, there is shown a side view of a modified first portion 105' according to an alternative embodiment of the present invention.

In this alternative embodiment a perimeter of the first aperture comprises a first perimeter portion 300' and a second perimeter portion 305'. The second perimeter portion 305' is provided closer to an end of the male part 125' than the first perimeter portion 300'.

The first perimeter portion 300' comprises a portion of the circumference of a first circle (of the radius $R_1$). The second perimeter portion 305' comprises a portion of the circumference of a second circle (of radius R2). Beneficially $R_1$ is greater than $R_2$.

A centre $X_2$ of the second circle is closer to an end of the male part 125' than a centre $X_1$ of the first circle is to the end of the male portion 125'.

A perimeter of the second aperture(s) comprises the circumference of a third circle (of radius R3).

In use, when the first portion 105' is lowered into the receptacle, the second aperture of the female portion is in axial alignment with the centre $X_1$ of the portion of the first aperture with larger radius $R_1$. This provides for relatively large clearance between the first portion 105' and the pin, which facilitates for ease of installation of the pin.

When the connector 100 is tensioned and under load, the first portion 105' moves back out of the receptacle by an offset amount, i.e. a distance between centre $X_1$ of the first circle and centre $X_2$ of second circle. The pin then contacts second perimeter portion of radius $R_2$. This acts to increase a contact area between the pin and first portion 105', in use, when under load. Such acts to reduce contact stress between the first portion 105' and the pin and/or provides for longer fatigue life in use.

It will also be appreciated that the embodiments of the present invention hereinbefore described are given by way of example only, and are not meant to limit the scope of the invention in any way.

The present invention provides particular advantage over the prior art, in that it provides 'top entry' connection, i.e. the male part is inserted within the female part in a vertical disposition, which facilitates particular ease of connection. It will also be understood that the connector of the present invention provides a structural load bearing element.

While the disclosed embodiment discloses use of a suction pile, it will be appreciated that other types of anchors can be used, such as driven piles and drag embedment anchors, and suction embedded anchors, torpedo anchors, or the like.

It will be appreciated that the present invention may be advantageous or beneficial, since as the offshore industry moves to ultra-deep waters, new mooring technology is beneficial, e.g. for mobile offshore drilling units (MODUs), and deep water production vessels (FOSOs, FSOs, TiPs and Spars). The connector of the invention provides a disconnectable, permanent subsea mooring connector which allows operators to change out mooring components with an anchor handling vessel (AHV) without having to unseat an anchor.

The invention claimed is:

1. A subsea connector comprising a first portion and a second portion, an arrangement for connecting the first portion and the second portion, and an arrangement for rotationally aligning the first portion and the second portion, the arrangement for rotationally aligning the first and second portions comprising a first alignment member and a second alignment member carried by or provided on the respective first and second portions, wherein the first alignment member comprises first and second prongs or teeth, and the second alignment member comprises an elongate member, and wherein the elongate member at least partly spans across a bore of the second portion.

2. The subsea connector as claimed in claim 1, wherein the first and second portions are connectable to a respective line.

3. The subsea connector as claimed in claim 1, wherein the second alignment member is transverse to the bore with respect to a longitudinal axis of the second portion.

4. The subsea connector as claimed in claim 1, wherein the first alignment member and the second alignment member co-act when the first and second portions are brought together or mated.

5. The subsea connector as claimed in claim 1, wherein the first portion comprises a male part and the second portion comprises a female part.

6. The subsea connector as claimed in claim 5, wherein the elongate member at least partly spans the female part.

7. The subsea connector as claimed in claim 5, wherein insertion of the male part into the female part causes the first alignment member and the second alignment member to rotationally co-act or ride over one another, thereby relatively longitudinally rotating the male part and the female part into a pre-selected or pre-determined rotational disposition.

8. The subsea connector as claimed in claim 7, wherein in the pre-selected rotational disposition the first and second prongs or teeth are disposed on respective first and second sides of the elongate member.

9. The subsea connector as claimed in claim 7, wherein a portion of the male part transversely between the prongs or teeth is adjacent or in contact with the elongate member.

10. The subsea connector as claimed in claim 7, wherein the arrangement for connecting the first portion and the second portion comprises a first aperture in the male part, wherein the arrangement for connecting the first portion and the second portion comprises at least one second aperture in the female part, and wherein the first aperture and the at least one second aperture are aligned in said pre-selected rotational disposition.

11. The subsea connector as claimed in claim 1, wherein the arrangement for connecting comprises an arrangement for releasably connecting.

12. The subsea connector as claimed in claim 1, wherein the first alignment member comprises at least one first surface and the second alignment member comprises at least one second surface.

13. The subsea connector as claimed in claim 12, wherein the at least one first surface and the at least one second surface abut one another and/or rotate with respect to one another around a longitudinal axis and/or ride-over one another when the first and second portions are longitudinally brought together or mated.

14. The subsea connector as claimed in claim 1, wherein the first and second prongs or teeth are diametrically or width-wise opposite one another, and disposed on opposite sides of or along a common diameter or width.

15. The subsea connector as claimed in claim 14, wherein a slot or recess portion is provided diametrically between the first and second prongs or teeth.

16. The subsea connector as claimed in claim 1, wherein at least a portion of each prong or tooth is radially disposed on an end of the first alignment member.

17. The subsea connector as claimed in claim 1, wherein the first portion comprises a male part, the male part comprising a cylindrical portion, and wherein the second portion comprises a female part, the female part comprising a bore within which the cylindrical portion is received in a substantially tight or snug fit.

18. The subsea connector as claimed in claim 1, wherein the first portion comprises a male part, and wherein the arrangement for connecting the first portion and the second portion comprises a first aperture in the male part, spanning diametrically or width-wise the cylindrical portion of the male part.

19. The subsea connector as claimed in claim 18, wherein a perimeter of the first aperture comprises a first perimeter portion and a second perimeter portion, and wherein the second perimeter portion is provided closer to an end of the first portion than the first perimeter portion.

20. The subsea connector as claimed in claim 19, wherein the first perimeter portion comprises a portion of a circumference of a first circle of the radius $R_1$, and wherein the second perimeter portion comprises a portion of a circumference of a second circle of radius $R_2$.

21. The subsea connector as claimed in claim 20, wherein $R_1$ is greater than $R_2$.

22. The subsea connector as claimed in claim 1, wherein the second portion comprises a female part, and wherein the arrangement for connecting the first portion and the second portion comprises at least one aperture in the female part.

23. The subsea connector as claimed in claim 22, wherein a perimeter of the at least one second aperture comprises a circumference of a third circle of radius $R_3$.

24. The subsea connector as claimed in claim 1, wherein the first portion comprises a male part, wherein the arrangement for connecting the first portion and the second portion comprises a first aperture in the male part, wherein the second portion comprises a female part, wherein the arrangement for connecting the first portion and the second portion comprises at least one second aperture in the female part, and wherein the arrangement for connecting the first portion and the second portion comprises a pin, removably receivable within the at least one first aperture and the at least one second aperture when such are aligned.

25. The subsea connector as claimed in claim 24, wherein a remotely operated vehicle is used to mate and/or release the first and second portions, and/or to insert and/or remove the pin.

26. A subsea structure moored by one or more lines, wherein at least one of the lines comprises at least one subsea connector according to claim 1.

27. A method of mooring a subsea structure by one or more lines comprising connecting at least one of said lines with a subsea connector according to claim 1.

28. A subsea connector as claimed in claim 1, wherein the elongate member is transverse to a longitudinal bore of the second portion.

29. The subsea connector as claimed in claim 1, wherein the subsea connector comprises a mooring connector.

30. The subsea connector as claimed in claim 28, wherein the subsea connector comprises a mooring connector.

31. A method of mooring a subsea structure by one or more lines comprising the step of connecting at least one of said lines with a subsea connector according to claim 1.

32. The subsea connector as claimed in claim 1, wherein the elongate member diametrically spans the bore of the second portion.

33. A subsea connector comprising a first portion and a second portion, an arrangement for connecting the first portion and the second portion, and an arrangement for rotationally aligning the first portion and the second portion, the arrangement for rotationally aligning the first and second portions comprising a first alignment member and a second alignment member carried by or provided on the respective first and second portions, wherein the first alignment member comprises first and second prongs or teeth, and the second alignment member comprises an elongate member, wherein the first portion comprises a male part, and wherein the arrangement for connecting the first portion and the second portion comprises a first aperture in the male part, spanning diametrically or width-wise the cylindrical portion of the male part, wherein a perimeter of the first aperture comprises a first perimeter portion and a second perimeter portion, and the second perimeter portion is provided closer to an end of the first portion than the first perimeter portion, wherein the first perimeter portion comprises a portion of a circumference of a first circle of radius $R_1$, and wherein the second perimeter portion comprises a portion of a circumference of a second circle of radius $R_2$, and wherein a center of the second circle is closer to an end of the first portion than a center of the first circle is to the end of the first portion.

* * * * *